United States Patent [19]

Bergin

[11] Patent Number: 4,493,616

[45] Date of Patent: Jan. 15, 1985

[54] PUMP ASSEMBLY AND OPERATING METHOD

[75] Inventor: Thomas F. Bergin, Highland Heights, Ohio

[73] Assignee: TRW Inc., Cleveland, Ohio

[21] Appl. No.: 422,596

[22] Filed: Sep. 24, 1982

[51] Int. Cl.[3] ..... F04B 23/14; F04B 49/00; F01C 1/00

[52] U.S. Cl. ..... 417/53; 417/203; 417/205; 417/299; 418/177

[58] Field of Search ..... 417/203, 201, 202, 205, 417/368, 372, 299, 53; 418/177, 268, 267

[56] References Cited

U.S. PATENT DOCUMENTS

| | | | |
|---|---|---|---|
| 3,102,494 | 9/1963 | Adams | 418/268 |
| 3,128,708 | 4/1964 | Henning | 417/203 |
| 3,560,120 | 2/1971 | Gannaway et al. | 417/372 |
| 3,851,998 | 12/1974 | Downing . | |
| 3,941,505 | 3/1976 | Nasvytis et al. . | |
| 4,247,263 | 1/1981 | Pech et al. | 417/203 |

*Primary Examiner*—Richard E. Gluck
*Assistant Examiner*—Peter M. Cuomo
*Attorney, Agent, or Firm*—Yount & Tarolli

[57] ABSTRACT

An improved pump assembly is used to supply fuel to an aircraft engine and includes a positive displacement pump which supplies fuel during low speed operation of the pump assembly and a centrifugal pump which supplies fuel during relatively high speed operation of the pump assembly. The positive displacement pump has a plurality of vanes connected with an impeller of the centrifugal pump. The vanes are forced radially inwardly against a stationary cam surface by fluid pressure. The fluid pressure is conducted from an outlet of the positive displacement pump through a passage in the impeller of the centrifugal pump to pressure chambers disposed at outer ends of the vanes. By providing the fluid pressure passage in the impeller of the centrifugal pump, the axial length of the pump assembly tends to be minimized. The positive displacement pump is rendered ineffective to pump fluid when the output pressure from the centrifugal pump equals the output pressure from the positive displacement pump. When the positive displacement pump is ineffective, the components of the positive displacement pump are lubricated by fluid which flows from the positive displacement pump to the centrifugal pump through a common drive shaft for the two pumps.

10 Claims, 8 Drawing Figures

PUMP ASSEMBLY AND OPERATING METHOD

BACKGROUND OF THE INVENTION

The present invention relates to a new and improved pump assembly having a positive displacement pump and a centrifugal pump.

Pump assemblies which include positive displacement and centrifugal pumps are used to supply fuel to aircraft engines. During starting and low speed operation of the engine, the positive displacement pump is effective to supply fuel to the engine. As the engine speed increases, the centrifugal pump supplies the increased demand for fuel by the engine. Various pump assemblies having centrifugal and positive displacement pumps for supplying fuel to an engine are disclosed in U.S. Pat. Nos. 3,851,998; 3,941,505; and 4,247,263.

The pump assembly disclosed in U.S. Pat. No. 3,851,998 includes a positive displacement pump having vane elements which are mounted on an impeller of a centrifugal pump. During low speed operation of the pump assembly, the vane elements are biased inwardly agaist a stationary cam surface by springs and fluid pressure. When a predetermined idle speed is reached, a change-over valve is operated to throttle the flow of inlet fluid to the positive displacement pump and direct the fluid to the main or centrifugal pump. As the flow of fuel to the positive displacement pump is blocked, the fluid pressure urging the vanes into engagement with the stationary cam surface is vented so that the vanes are free to move outwardly under the influence of centrifugal force. This reduces the heat generated by the positive displacement pump and the power required to operate the pump assembly.

SUMMARY OF THE PRESENT INVENTION

The present invention provides a new and improved pump assembly which is advantageously used to supply fuel to an aircraft engine. The pump assembly includes a positive displacement pump which supplies fuel at relatively low pump operating speeds and a centrifugal pump which supplies the fuel at relatively high pump operating speeds. The positive displacement pump includes a plurality of vanes which are urged into engagement with a cam surface by fluid pressure and a spring force.

In accordance with a feature of the present invention, the fluid pressure which urges the vanes into engagement with the cam surface is conducted through a passage formed in the impeller of the centrifugal pump. By providing the fluid passage in the impeller of the centrifugal pump, the overall axial length of the pump assembly tends to be minimized. In addition, the fluid conduit arrangement associated with the positive displacement pump is shortened and thereby simplified.

During high speed engine operation, the centrifugal pump has an output which is sufficient to satisfy the demand for fuel. Therefore, the positive displacement pump is rendered ineffective to pump fluid when the output pressures of the centrifugal and positive displacement pumps are equal. The output pressures of the centrifugal and positive displacement pumps will be equal at a predetermined operating speed. Therefore, the positive displacement pump is always rendered ineffective to pump fluid at the same operating speed.

In accordance with another feature of the invention, the fluid conduit arrangement associated with the positive displacement pump is connected with a lubricating fluid passage which extends axially through the impeller. The lubricating fluid passage conducts a restricted flow of fuel between the centrifugal pump and the positive displacement pump to provide fluid to lubricate the components of the positive displacement pump when the engine fuel requirements are being supplied by the centrifugal pump.

Accordingly, it is an object of this invention to provide a new and improved pump assembly having a positive displacement pump and a centrifugal pump and wherein vanes of the positive displacement pump are urged into engagement with the cam surface by fluid pressure conducted through a passage formed in an impeller of the centrifugal pump.

Another object of this invention is to provide a new and improved pump assembly and method in which a positive displacement pump is rendered ineffective when the fluid pressure output from a centrifugal pump is equal to the fluid pressure output from the positive displacement pump.

Another object of this invention is to provide a new and improved pump assembly and method as set forth in the preceeding object and wherein the positive displacement pump is connected with a passage through which fluid flows to lubricate the components of the positive displacement pump when it is ineffective.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
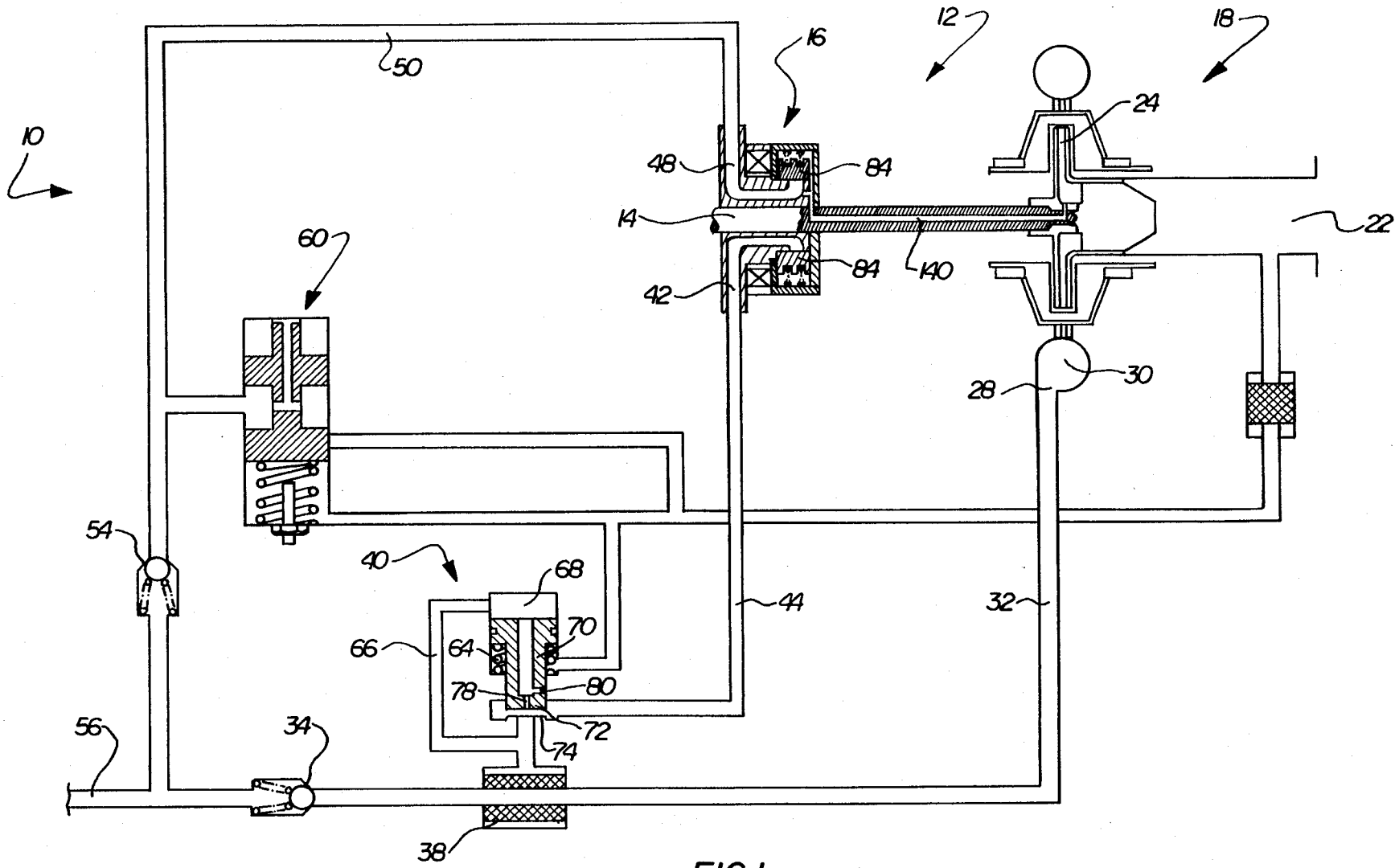
FIG. 1 is a schematic illustration of a fuel supply system for an aircraft engine.

A fuel supply system 10 for supplying fuel to an aircraft engine is illustrated schematically in FIG. 1. The fuel supply system 10 includes a pump assembly 12 (FIGS. 1 and 2) having an engine driven drive shaft 14 which drives both a positive displacement or cranking stage pump 16 and a centrifugal or main stage pump 18.

During low speed operation of the aircraft engine, such as during starting of the engine, the positive displacement pump 16 is effective to supply fuel to the engine. As the engine operating speed increases, the centrifugal main stage pump 18 becomes effective to supply fuel to the engine.

During low speed operation of the aircraft engine, fuel from a tank (not shown) is conducted to the centrifugal pump 18 through a main fuel supply line or conduit 22 (FIG. 1). At this time, the drive shaft 14 is rotating an impeller 24 at a very low speed so that the fuel from the main supply conduit 22 flows through the centrifugal pump 24 to an outlet 28 of a volute 30 (FIGS. 1 and 2) at a relatively low pressure. This low pressure flow of fuel is conducted through a conduit 32 (FIG. 1) to a main stage check valve 34. The fluid pressure in the conduit 32 is, at this time, ineffective to open the main stage check valve 34.

The relatively low pressure fuel in the conduit 32 is conducted to the positive displacement pump 16. Thus, the fuel flows through a filter 38 to a normally open cranking stage shutoff valve 40. The cranking stage shutoff valve 40 is connected in fluid communication with an inlet 42 to the positive displacement pump 16 by a conduit 44.

Even though the positive displacement pump 16 is being driven at a relatively low speed by the drive shaft 14, the positive displacement pump discharges fuel under pressure through an outlet passage 48 to a conduit 50. The fluid pressure in the conduit 50 is effective to open a cranking stage check valve 54 to enable fluid to flow through the check valve to a main fluid supply conduit 56 which is connected in fluid communication with the aircraft engine. A bypass valve 60 is provided to regulate the fluid pressure in the discharge conduit 50. Thus, the bypass valve 60 is actuated to connect the discharge conduit 50 in fluid communication with the inlet conduit 22 when the fluid pressure in the discharge conduit becomes excessive.

As the engine operating speed increases, the pressure at which the centrigual pump 18 (FIG. 1) discharges fuel increases and the main stage check valve 34 opens. At this time, fuel will be supplied to the engine by both the centrifugal pump 18 and the positive displacement pump 16. However when the fluid pressure output from the centrifugal pump 18 equals the fluid pressure output from the positive displacement pump 16, the positive displacement pump 16 is rendered ineffective. The engine fuel requirements are then supplied by the centrifugal pump 18. As the output pressure from the centrifugal pump continues to increase, the cranking stage shutoff valve 40 is urged to a closed condition against the influence of a biasing spring 64.

To effect closing of the cranking stage shut off valve, the conduit 66 conducts fluid pressure to a chamber 68 at the head end of a piston type valve 70. Fluid pressure in the chamber 68 presses the valve member 70 downwardly (as viewed in FIG. 1) to move a nose or end surface 72 of the valve member toward a valve seat 74. When the output pressure from the centrifugal pump exceeds a predetermined pressure, valve surface 72 engages the valve seat 74 to greatly restrict fluid flow to the positive displacement pump. However, a minimum flow of fluid is maintained through passages 78 and 80 to provide fluid to lubricate the components of the positive displacement pump 16.

As the operating speed of the pump assembly 12 is being increased from a relatively low speed to a relatively high speed, the positive displacement pump 16 is rendered ineffective at a predetermined operating speed at which the output pressure from the centrifugal pump 18 equals the output pressure from the positive displacement pump. At this time the vanes 84 (FIGS. 2 and 3) in the positive displacement pump 16 move radially outwardly away from a stationary cam surface 86 under the influence of centrifugal force. When the vanes 84 move radially outwardly away from the cam surface 86, the positive displacement pump 16 is no longer effective to supply fluid under pressure to the outlet conduit 48. This results in a decrease in the fluid pressure in the conduit 50 so that the cranking stage check valve 54 closes. At this time, the centrifugal pump 18 supplies the engine fuel requirements.

Figure 2:
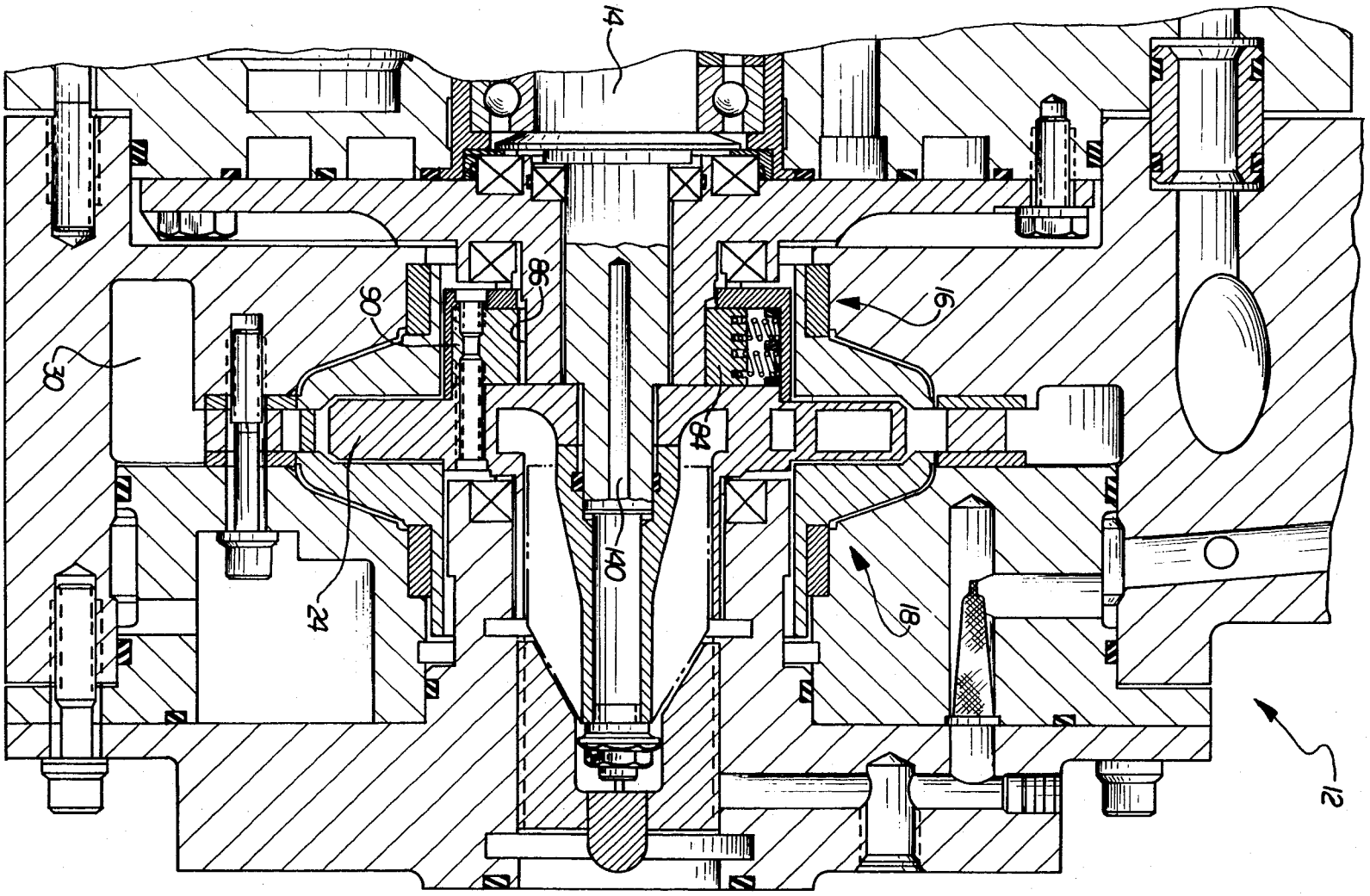
FIG. 2 is a fragmentary sectional view of a pump assembly used in the fuel supply system of FIG. 1.
Figure 3:
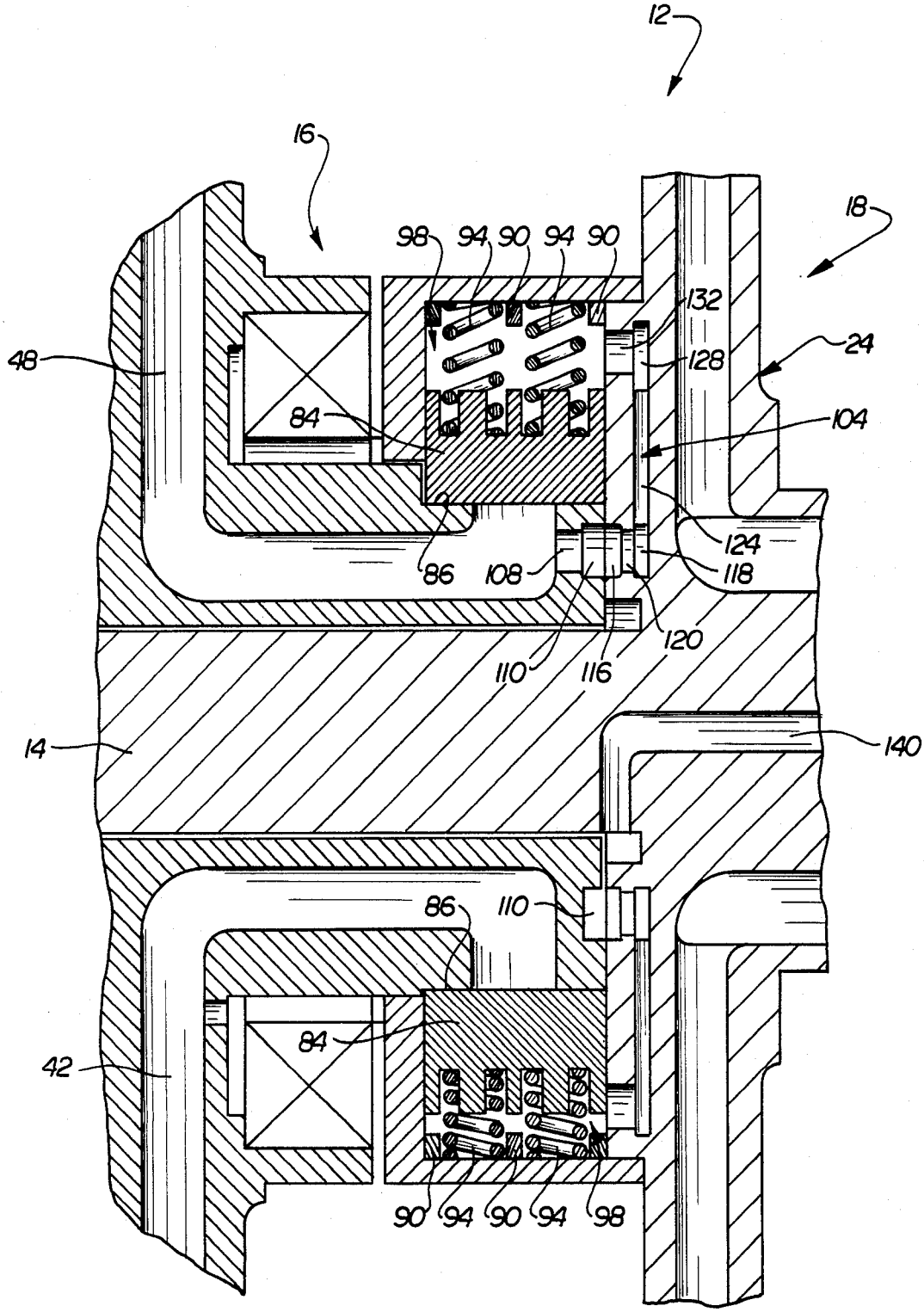
FIG. 3 is an enlarged schematic illustration of a portion of the pump assembly of FIG. 2 and illustrating the relationship between vanes of a positive displacement pump and an impeller of a centrifugal pump.

The positive displacement pump 16 is of the well known vane type and includes vanes 84 (FIGS. 2 and 3) which are disposed in a circular array around the stationary cam surface 86. The vanes 84 separate pumping or working chambers disposed in a circular array around cam surface 86. The vanes 84 are slidably mounted in slots formed in an annular mounting or support ring 90 (FIG. 2). The annular mounting ring 90 is bolted to the impeller 24 of the centrifugal pump 18. The impeller 24 of the centrifugal pump 18 and the vane mounting ring 90 of the positive displacement pump 16 are rotated by the drive shaft 14 which is fixedly secured to the bore of the impeller.

Each of the vanes 84 is biased radially inwardly toward the cam surface 86 under the combined influence of biasing springs 94 (FIGS. 3 and 4) and fluid pressure in chambers 98. The fluid pressure chambers 98 are disposed in an annular array about the mounting ring 90. Each of the fluid pressure chambers 98 is disposed at the radially outer end portion of one of the vanes 84 and holds fluid under pressure to urge the vane radially inwardly against the cam surface 86.

In accordance with a feature of the present invention, the pressure chambers 98 are connected in fluid communication with a source of fluid pressure through passages formed in the impeller 24. By conducting the biasing fluid pressure through the passages formed in the impeller 24 of the centrifugal pump 18, the overall axial extent of the pump assembly 12 tends to be minimized. In addition, the number of separate fluid passages required to supply fluid to the pressure chambers 98 tends to be reduced.

Figure 4:
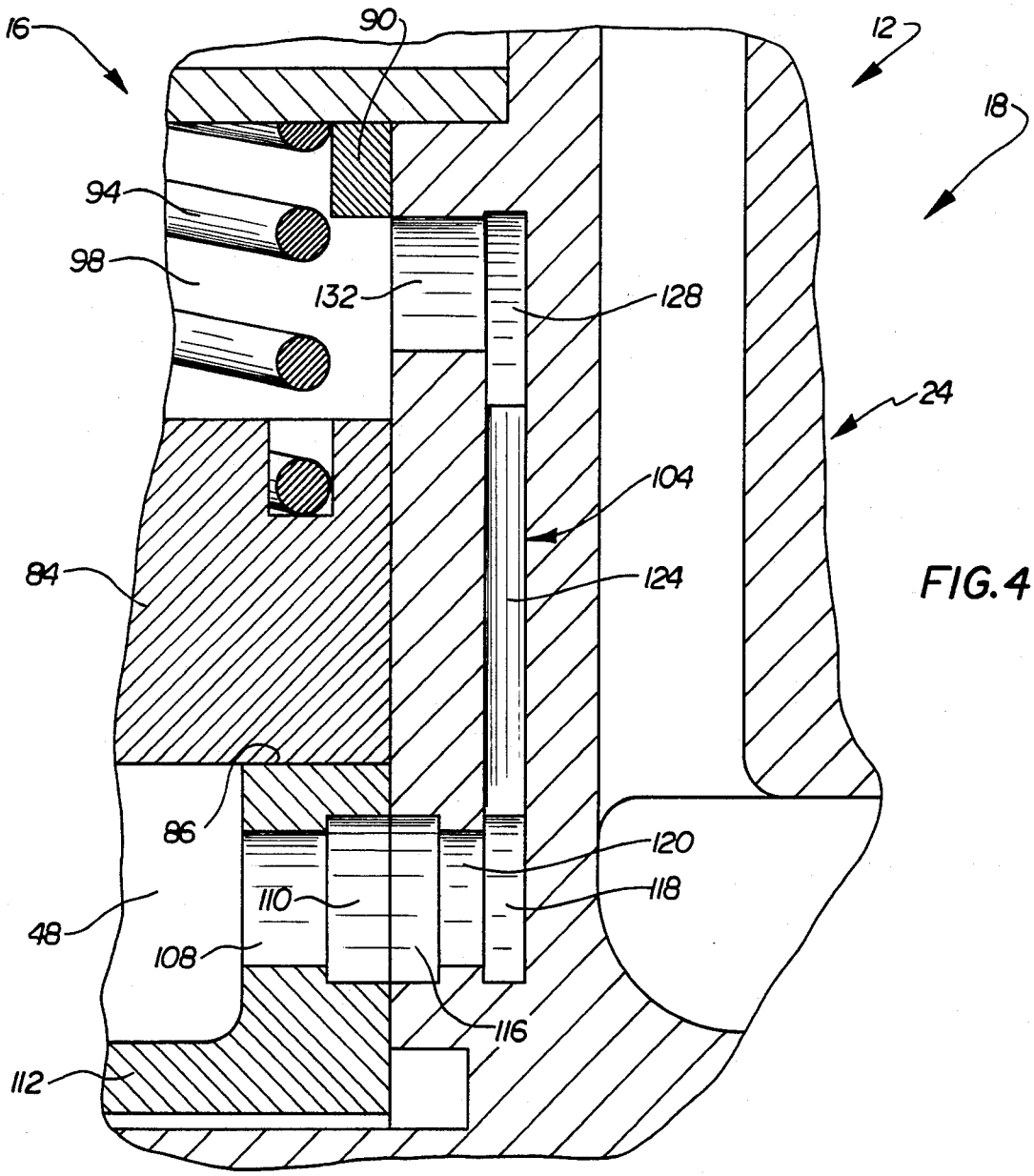
FIG. 4 is an enlarged fragmentary view of a portion of FIG. 3 and illustrating a passage system for conducting fluid pressure from an outlet of the positive displacement pump through passages formed in the impeller of the centrifugal pump to pressure chambers at end portions of the vanes of the positive displacement pump.

A biasing fluid pressure passage system 104 for conducting fluid pressure from the outlet 48 of the positive displacement pump 16 to the pressure chambers 98 is illustrated in FIG. 4. The biasing fluid pressure passage system 104 includes an inlet 108 which extends between the outlet passage 48 and an annular manifold ring 110 formed in a member 112 upon which the cam surface 86 is disposed. The annular manifold ring 110 circumscribes the drive shaft 14 (see FIG. 3).

The annular manifold ring 110 (FIG. 4) in the positive displacement pump 16 faces an annular manifold ring 116 formed in the impeller 24. The annular manifold ring 116 in the impeller 24 circumscribes the drive shaft 14 and is connected in fluid communication with another manifold ring 118 through a passage 120. The manifold ring 118 is coaxial with the manifold rings 116 and 110.

The manifold ring 118 is connected in fluid communication with a plurality or radially outwardly extending passages 124 formed in the impeller 24. The radially extending passages 124 are connected with an annular outer manifold ring 128 which is also formed in the impeller 24. The manifold ring 128 is connected in fluid communication with a pressure chamber 98 through a passage 132 formed in the impeller 24. Since there are a plurality of vanes 84 and associated pressure chambers 98, there are a plurality of passages 132 to connect the annular manifold ring 128 in fluid communication with each of the pressure chambers 98.

During operation of the positive displacement pump 16, fluid pressure is conducted from the pump outlet 48 (FIG. 4) through the passage system 104 to each of the pressure chamber 98. Therefore, all of the vanes 84 are urged radially inwardly into abutting engagement with the cam surface 86 by fluid pressure. Thus, fluid pressure from the outlet 48 flows to the manifold ring 110 in positive displacement pump 16. This fluid pressure is conducted from the manifold ring 110 to the manifold ring 116 in the rotating impeller 24. The fluid pressure is transmitted from the manifold ring 116 to the manifold ring 118 and the radially extending passages 124 in the impeller.

From the impeller passages 124, the fluid pressure is transmitted to the radially outer manifold ring 128. The manifold ring 128 in the impeller 24 is connected in fluid communication with the pressure chambers 98 through passages 132 formed in the impeller. Since the mounting ring 90 and vanes 84 are connected with the impeller 24 for rotation therewith, a continuous fluid connection is maintained between the pump outlet 48 and each of the pressure chambers 98 during operation of the positive displacement pump 16.

Figure 6:
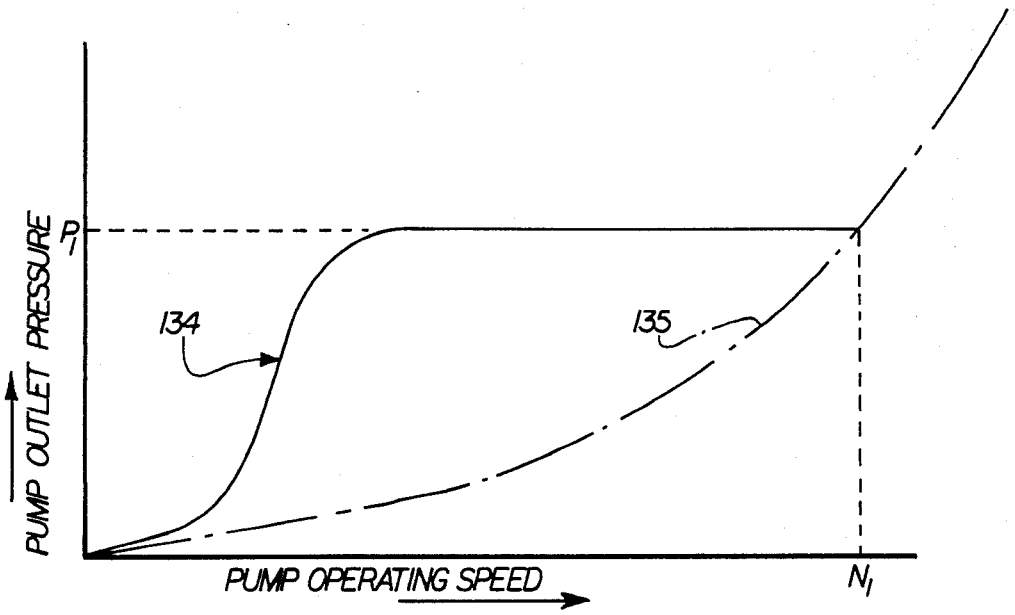
FIG. 6 is a graph illustrating the relationship between output pressure and operating speed for the centrifugal and positive displacement pumps.

In accordance with another feature of the present invention, the positive displacement pump 16 is rendered ineffective to apply fluid when a predetermined operating speed of the pump assembly 12 is reached. At this predetermined operating speed, the output pressure of the positive displacement pump 16 and the output pressure of the centrifugal pump 18 are equal. The manner in which the output pressure of the positive displacement pump 16 varies with pump operating speed is indicated by a curve 134 in FIG. 6. The manner in which the output pressure of the centrifugal pump 18 varies with pump operating speed is indicated by the curve 135 in FIG. 6.

During operation of the pump assembly 12, the output pressure of the positive displacement pump 16 quickly increases to a maximum pressure $P_1$ and is maintained at this pressure by the bypass valve 60. As the speed at which the drive shaft 14 drives both the positive displacement pump 16 and centrifugal pump 18 increases, the output pressure of the centrifugal pump 18 approaches the output pressure of the positive displacement pump 16. At a predetermined speed $N_1$, the output pressure of the centrifugal pump 18 will just equal the output pressure of the positive displacement pump 16.

When the output pressure of the positive displacement and centrifugal pumps 16 and 18 are equal, there is no pressure differential between the inlet and outlet of the positive displacement pump 16. At this time, the same fluid pressure is present in each of the pumping chambers of the positive displacement pump 16. Therefore, static friction forces tending to hold vanes against radially outward movement away from the cam surface 86 are elmiminated.

Figure 7:
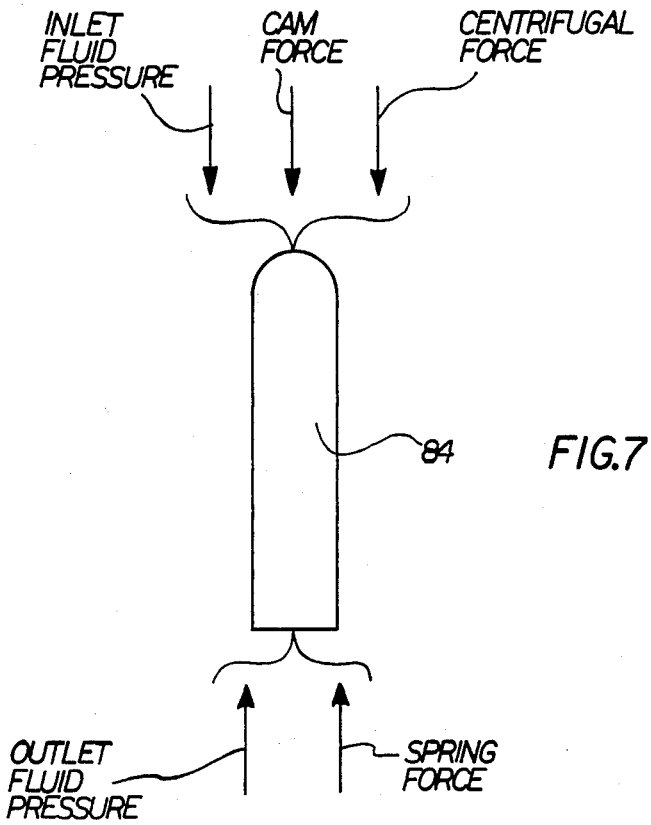
FIG. 7 is a schematic illustration of the forces on a vane of the positive displacement pump.

When the output pressures of the positive displacement and centrifugal pumps 16 and 18 are equal, each of the vanes 84 is subjected to a combination of forces indicated schematically in FIG. 7. Thus, each vane 84 is pressed inwardly toward the cam surface 86 under the influence of the springs 94 and the outlet fluid pressure force in the chamber 98. Each vane 84 is urged away from the cam surface 86 under the influence of the inlet fluid pressure, a force applied against the vane 84 by the cam surface 86, and by centrifugal force.

The springs 94 has been sized so that when the fluid pressure conducted to the inlet area 42 of the positive displacement pump 16 is equal to the fluid pressure at the outlet area 48 of the positive displacement pump, the vanes 84 move out of engagement with the cam 86. This renders the positive displacement pump 16 ineffective to pump fluid.

Accordingly, when the operating speed of the centrifugal pump 18 is equal to the speed $N_1$ (see FIG. 6), the vanes 84 in the positive displacement pump 16 move out of engagement with the cam 86 to render the positive displacement pump 16 ineffective. Although this occurs at substantially the same operating speed, that is $N_1$, there may be a slight variation in the operating speed at which the vanes 84 move out of engagement with the cam 86. However, this variation is minimal.

As the operating speed of the pump assembly 12 (see FIG. 1) increases above the speed $N_1$ (FIG. 6), the output pressure from the centrifugal pump 18 increases and forces the cranking stage shutoff valve 40 to a closed condition. When the cranking stage shutoff valve 40 is closed, fluid flow to the positive displacement pump 16 is substantially blocked by the shutoff valve. This results in a reduction in the fluid pressure at the outlet 48 of the positive displacement pump 16. The reduction in the fluid pressure at the outlet 48 is transmitted through the passage system 104 (see FIG. 4) to the pressure chambers 98.

Once the cranking stage shut off valve 40 has closed, the operating components of the positive displacement pump 16 are still rotated by the drive shaft 14 even though the pump is ineffective. In order to lubricate the closely fitting components of the positive displacement pump 16, the cranking stage shut off valve 40 has passages 78 and 80 through which a restricted flow of fluid is provided to the positive displacement pump 16 even when the valve is closed. The flow of fluid from the positive displacement pump 16 is conducted back to the centrifugal pump 18 through a lubricating passage 140 (see FIGS. 1 and 3) which extends through the drive shaft 14 to the axially outer end portion of the centrifugal pump 18.

Figure 5:
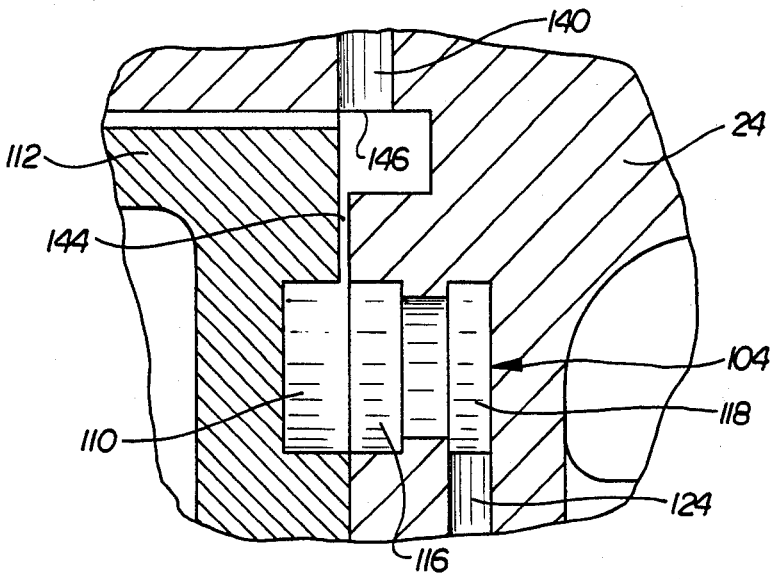
FIG. 5 is an enlarged fragmentary view illustrating the relationship between the passage system of FIG. 4 and a passage through which fluid flows to lubricate components of the positive displacement pump during low and high speed operation.

The lubricating fluid passage 140 (see FIG. 3) is connected in communication with the biasing fluid pressure passage system 104 through a labrynth seal 144 (see FIG. 5). The seal 144 restricts, without completely blocking, fluid flow from the annular manifold ring 110 to an inlet 146 to the lubricant fluid passage 140. There is sufficient fluid flow from the biasing fluid pressure passage system 104 to the lubricant fluid passage 140 to provide fluid in the positive displacement assembly 16 to lubricate the components of the pump assembly as it is driven by the drive shaft 14.

Figure 8:
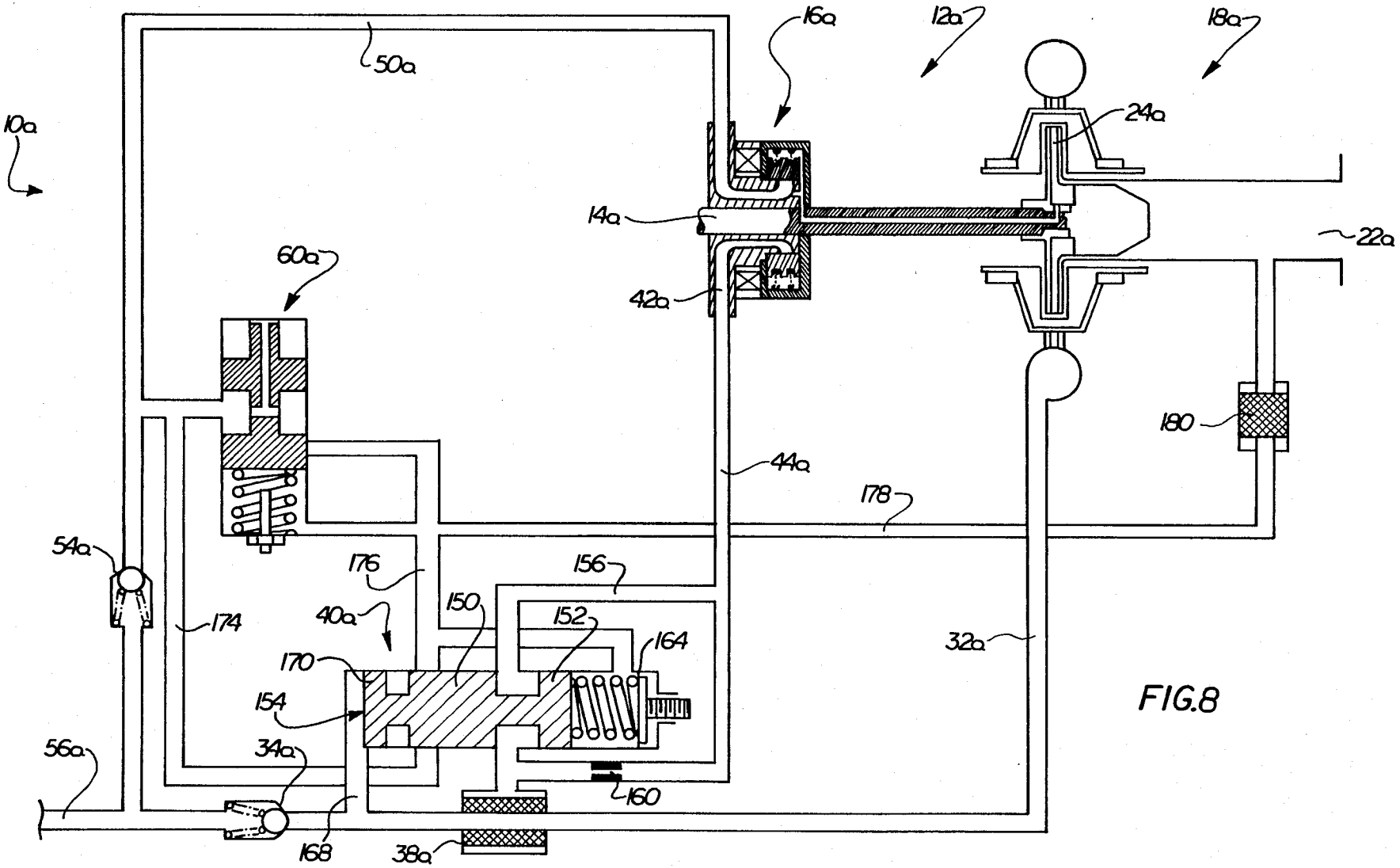
FIG. 8 is a schematic illustration of a second embodiment of the invention.

In the embodiment of the invention shown in FIGS. 1–7, the cranking stage shut off valve 40 is operable to a closed condition to restrict fluid flow of the positive displacement pump 16. However, the output from the positive displacement pump 16 is still conducted to the conduit 50 leading to the main fuel supply conduit 56. In the embodiment of the invention shown in FIG. 8, operation of a cranking stage cut off valve connects the output from the positive displacement pump to the input to the centrifugal pump. Since the embodiment of the invention shown in FIG. 8 is generally similar to the embodiment of the invention shown in FIGS. 1–7, similar numerals will be utilized to designate similar components, the suffix letter "a" being associated with FIG. 8 to avoid confusion.

A fuel supply system 10a (FIG. 8) includes a pump assembly 12a having an engine driven drive shaft 14a which drives both a positive displacement or cranking stage pump 16a and a centrifugal or main stage pump 18a. During low speed operation of an aircraft engine, such as during starting of the engine, the positive displacement pump 16a is effective to supply fuel to the engine. As the engine operating speed increases, the centrifugal main stage pump 18a becomes effective to supply fuel to the engine.

During low speed operation of the aircraft engine, fuel from a tank is conducted to the centrifugal pump 18a through a main fuel supply line or conduit 22a. At this time, the drive shaft 14a is rotating an impeller 24a at a very low speed so that fluid from the main supply conduit 22a is discharged from the centrifugal pump 18a at a relatively low pressure to a conduit 32a. This low pressure flow of fuel is conducted through the conduit 32a through a normally open cranking stage shut off valve 40a to the positive displacement pump 16a.

Even though the positive displacement pump 16a is being driven at a relatively low speed by the drive shaft 14a, the positive displacement pump discharges fuel under pressure to a conduit 50a. The fluid pressure in the conduit 50a is effective to open a check valve 54a to enable fuel to flow through the check valve to the main supply conduit 56a. A bypass valve 60a is provided to regulate the fluid pressure in the discharge conduit 50a.

When the cranking stage cut off valve 40a is in the open position shown in FIG. 8, fuel flows from the conduit 32a through a filter 38a to the cranking stage cut off valve 40a. The fluid flows between a pair of lands 150 and 152 formed on a valve spool 154 to a passage 156 connected to a conduit 44a leading to the inlet 42a of the positive displacement pump 16a. In addition, a restricted flow of fuel flows through an orifice 160 to the conduit 44a. A biasing spring 164 engages the land 152 to hold the valve spool 154 in the open position shown in FIG. 8.

As the operating speed of the pump assembly 12a is increased so that the output pressure from the centrifugal pump 18a exceeds the output pressure from the positive displacement pump 16a, the cranking stage shut off valve 154 is actuated to a closed condition blocking fluid flow from the conduit 32a through the groove between the valve lands 150 and 152 to the conduit 156. Thus, fluid pressure is conducted from the conduit 32a through a conduit 168 to a head end land 170 of the valve spool 154. This fluid pressure urges the valve spool toward the right (as viewed in FIG. 8) to move the valve spool against the influence of the spring 164. As this occurs, the land 150 blocks direct fluid communication from the conduit 32a to the conduit 156. However, a restricted flow of lubricating fluid is conducted through the orifice 160 to the positive displacement pump 16a.

When the cranking stage cut off valve 40a is actuated under the influence of fluid pressure against the head end land 170, the positive displacement pump discharge conduit 50a is connected in fluid communication with the inlet 22a of the centrifugal pump 18a. Thus, a conduit 174 conducts fluid from the positive displacement pump discharge conduit 50a to the cranking stage cut off valve 40a. Upon actuation of the cranking stage cut off valve, the land 150 is moved to the right so that the conduit 174 is connected in fluid communication with a conduit 176 through an annular space between the head end land 170 and the land 150. The conduit 176 is connected in fluid communication with the pump inlet through a conduit 178 and filter 180.

In view of the foregoing it is apparent that the present invention provides a new and improved pump assembly 12 which is advantageously used to supply fuel to an aircraft engine. The pump assembly 12 includes a positive displacement pump 16 which supplies fuel at relatively low pump operating speeds and a centrifugal pump 18 which supplies the fuel at relatively high pump operating speeds. The positive displacement pump 16 includes a plurality of vanes 84 which are urged into engagement with a cam surface 86 by fluid pressure.

In accordance with a feature of the present invention, the fluid pressure which urges the vanes 84 into engagement with the cam surface 86 is conducted through passages 116, 118, 120, 124, 128 and 132 formed in the impeller 24 of the centrifugal pump 18. By providing the fluid passages in the impeller 24 of the centrifugal pump 18, the overall axial length of the pump assembly 12 tends to be minimized. In addition, the fluid conduit arrangement 104 associated with the positive displacement pump 16 is shortened and thereby simplified.

During high speed engine operation, the centrifugal pump 18 has an output which is sufficient to satisfy the demand for fuel. Therefore, the positive displacement pump 16 is rendered ineffective to pump fluid when the output pressures of the centrifugal and positive displacement pumps 16 and 18 are equal. The output pressures of the centrifugal and positive displacement pumps 16 and 18 will be equal at a predetermined operating speed. Therefore, the positive displacement pump 16 is always rendered ineffective to pump fluid at the same operating speed.

In accordance with another feature of the invention, the fluid conduit arrangement associated with the positive displacement pump is connected with a lubricating fluid passage 140 which extends axially through the impeller 24. The lubricating fluid passage 140 conducts a restricted flow of fuel between the positive displacement pump 16 and centrifugal pump 18 to provide fluid to lubricate the components of the positive displacement pump after it has been rendered ineffective to pump fuel.

Having described specific preferred embodiments of the invention, the following is claimed:

1. A pump assembly comprising positive displacement pump means for supplying fluid under pressure to an outlet during operation of the pump assembly at a relatively low speed, said positive displacement pump means including a cam surface, a plurality of vanes, and pressure chamber means for holding fluid pressure to urge said vanes into engagement with said cam surface, centrifugal pump means for supplying fluid under pressure during operation of the pump assembly at a relatively high speed, said centrifugal pump means including a rotatable impeller, and biasing fluid pressure passage means for conducting fluid pressure from the outlet of said positive displacement pump means to said pressure chamber means, said biasing fluid pressure passage means including a passage formed in said impeller and having a first end portion connected in fluid communication with the outlet of said positive displacement pump means and a second end portion connected in fluid communication with said pressure chamber means.

2. A pump assembly as set forth in claim 1 wherein said positive displacement pump means is ineffective to pump fluid during operation of said pump assembly at high speeds, said pump assembly further including lubricating fluid passage means for conducting a flow of lubricating fluid between said positive displacement pump means and said centrifugal pump means when said positive displacement pump means is ineffective to pump fluid.

3. A pump assembly as set forth in claim 2 wherein said lubricating fluid passage means extends in an axial direction along said impeller.

4. A pump assembly as set forth in claim 1 wherein said pressure chamber means includes a plurality of pressure chambers each of which is disposed adjacent to one end portion of one of said vanes, said passage formed in said impeller being connected in fluid communication with each of said pressure chambers.

5. A pump assembly as set forth in claim 1 further including mounting means for connecting said plurality of vanes with said impeller for rotation therewith relative to said cam surface.

6. A pump assembly as set forth in claim 1 further including pressure responsive valve means for restricting fluid flow to said positive displacement pump means in response to the fluid pressure discharged from said centrifugal pump means reaching a predetermined pressure.

7. A pump assembly as set forth in claim 1 further including means for urging said vanes into engagement with said cam surface with a force which is sufficient to maintain said vanes in engagement with said cam surface until the pressure at which fluid is discharged from said centrifugal pump means is equal to the pressure at which fluid is discharged from said positive displacement pump means and for allowing said vanes to move out of engagement with said cam surface when the pressure at which fluid is discharged from said centrifugal pump means equals the pressure at which fluid is discharged from said positive displacement pump means.

8. An apparatus as set forth in claim 1 further including valve means for connecting said pressure chamber means in fluid communication with a source of relatively low fluid pressure during operation of said pump assembly at a relatively high speed.

9. A method of supplying fluid to a system, said method comprising providing a positive displacement pump, providing a centrifugal pump having an inlet area at which fluid enters the centrifugal pump and an outlet area at which fluid is discharged from the centrifugal pump after the fluid has been conducted radially outwardly along an impeller of the centrifugal pump, driving the positive displacement pump at a relatively low speed, driving the centrifugal pump at a relatively low speed, conducting fluid at a relatively low pressure from the centrifugal pump outlet area to an inlet area of the positive displacement pump while driving the centrifugal pump at a relatively low speed, conducting fluid at a relatively high pressure from an outlet area of the positive displacement pump to the system while driving the positive displacement pump at a relatively low speed, increasing the speeds at which the positive displacement pump and centrifugal pump are driven, increasing the pressure at which fluid is discharged at the centrifugal pump outlet area to a relatively high pressure which is greater than the pressure at which fluid is discharged from the positive displacement pump while increasing the speed at which the centrifugal pump is driven, rendering the positive displacement pump ineffective to pump fluid when the fluid pressure conducted to the positive displacement pump inlet area from the centrifugal pump outlet area is equal to the fluid pressure at the positive displacement pump outlet area, and conducting fluid from the centrifugal pump outlet area to the system after having performed said step of rendering the positive displacement pump ineffective to pump fluid.

10. A method of supplying fluid to a system, said method comprising providing a positive displacement pump having a plurality of vanes which are carried by a rotatable support, providing a centrifugal pump, driving the positive displacement pump at a relatively low speed to rotate the vane support relative to a cam surface, driving the centrifugal pump at a relatively low speed, conducting fluid at a relatively low pressure from an outlet area of the centrifugal pump to an inlet area of the positive displacement pump, conducting fluid at a relatively high pressure from an outlet area of the positive displacement pump to the system while driving the positive displacement pump at a relatively low speed, urging each of the vanes in the positive displacement pump inwardly into engagement with the cam surface under the influence of a fluid pressure force which is a function of the pressure at which fluid is conducted from the positive displacement pump outlet area and a spring force as the vane support is rotated and the chambers sequentially move from the positive displacement pump inlet area to the positive displacement pump outlet area, urging vanes outwardly away from the cam surface under the influence of a fluid pressure force which is a function of the pressure at which fluid is conducted from the centrifugal pump outlet area to the positive displacement pump inlet area and centrifugal force applied to the vanes as a result of rotation of the vane support, increasing the speeds at which the positive displacement pump and centrifugal pump are driven, increasing the pressure at which fluid is discharged at the centrifugal pump outlet area to a relatively high pressure which is greater than the pressure at which fluid is discharged from the positive displacement pump while increasing the speed at which the centrifugal pump is driven, and moving vanes in the positive displacement pump outwardly away from the cam surface when the fluid pressure conducted to the positive displacement pump inlet area from the centrifugal pump outlet area is equal to the fluid pressure at the positive displacement pump outlet area.

* * * * *